US011367948B2

(12) United States Patent
Jordan et al.

(10) Patent No.: US 11,367,948 B2
(45) Date of Patent: Jun. 21, 2022

(54) MULTI-ELEMENT ANTENNA CONFORMED TO A CONICAL SURFACE

(71) Applicant: Cubic Corporation, San Diego, CA (US)

(72) Inventors: Jared Williams Jordan, Raleigh, NC (US); Timothy Amis Smith, Durham, NC (US); Freddy Pinero, Durham, NC (US); Brian Michael Kerrigan, Cary, NC (US)

(73) Assignee: CUBIC CORPORATION

( * ) Notice: Subject to any disclaimer, the term of this patent is extended or adjusted under 35 U.S.C. 154(b) by 0 days.

(21) Appl. No.: 16/997,176

(22) Filed: Aug. 19, 2020

(65) Prior Publication Data

US 2021/0119325 A1 Apr. 22, 2021

Related U.S. Application Data

(60) Provisional application No. 62/897,532, filed on Sep. 9, 2019.

(51) Int. Cl.

| | |
|---|---|
| ***H01Q 1/28*** | (2006.01) |
| ***H01Q 13/10*** | (2006.01) |
| ***H01Q 11/10*** | (2006.01) |
| ***H01Q 1/42*** | (2006.01) |

(52) U.S. Cl.

CPC ..... *H01Q 1/28* (2013.01); *H01Q 1/281* (2013.01); *H01Q 1/422* (2013.01); *H01Q 11/105* (2013.01); *H01Q 13/10* (2013.01)

(58) Field of Classification Search

CPC ..... H01Q 1/28; H01Q 13/10; H01Q 13/06; H01Q 21/0056; H01Q 1/281; H01Q 1/36

See application file for complete search history.

(56) References Cited

U.S. PATENT DOCUMENTS

| | | | | |
|---|---|---|---|---|
| 3,157,847 A | | 11/1964 | Williams | |
| 3,618,105 A | | 11/1971 | Bruene | |
| 3,699,574 A | * | 10/1972 | O'Hara | H01Q 3/242 342/154 |
| 3,820,041 A | | 6/1974 | Gewartowski | |
| 3,979,755 A | * | 9/1976 | Sandoz | H01Q 3/14 343/754 |
| 4,157,685 A | * | 6/1979 | Gerwin | F41G 5/14 102/214 |
| 4,218,685 A | | 8/1980 | Frosch | |
| 4,384,290 A | * | 5/1983 | Pierrot | G01S 13/74 244/3.19 |

(Continued)

FOREIGN PATENT DOCUMENTS

| | | |
|---|---|---|
| JP | 2008283012 | 11/2008 |
| JP | 2008307737 | 12/2008 |

(Continued)

OTHER PUBLICATIONS

Rajatendu Das: "Advances in Active Radar Seeker Technology", Defence Science Journal, vol. 55, No. 3, Jul. 2005, pp. 329-336. (Year: 2005).*

(Continued)

*Primary Examiner* — Vibol Tan

(74) *Attorney, Agent, or Firm* — Kilpatrick Townsend & Stockton, LLP

(57) ABSTRACT

Antenna integrated into a compact conical nosecone.

8 Claims, 15 Drawing Sheets

(56) References Cited

U.S. PATENT DOCUMENTS

| | | | | |
|---|---|---|---|---|
| 4,570,166 | A * | 2/1986 | Kuhn | F42B 10/46 343/872 |
| 4,647,942 | A | 3/1987 | Counselman, III | |
| 4,677,393 | A | 6/1987 | Sharma | |
| 4,994,817 | A | 2/1991 | Munson | |
| 5,405,267 | A | 4/1995 | Koegel | |
| 5,486,831 | A * | 1/1996 | Rowland | G01S 3/023 342/149 |
| 5,557,291 | A | 9/1996 | Chu | |
| 6,101,705 | A | 8/2000 | Wolfson | |
| 6,238,218 | B1 | 5/2001 | Baffert | |
| 6,317,099 | B1 | 11/2001 | Zimmerman | |
| 6,323,809 | B1 | 11/2001 | Maloney | |
| 6,356,241 | B1 | 3/2002 | Jaeger | |
| 6,512,487 | B1 | 1/2003 | Taylor | |
| 6,653,984 | B2 * | 11/2003 | Park | H01Q 1/42 343/770 |
| 6,842,158 | B2 | 1/2005 | Jo | |
| 7,012,489 | B2 | 3/2006 | Sherrer et al. | |
| 7,079,079 | B2 | 7/2006 | Jo | |
| 7,109,936 | B2 | 9/2006 | Mizoguchi | |
| 7,148,772 | B2 | 12/2006 | Sherrer et al. | |
| 7,405,638 | B2 | 7/2008 | Sherrer et al. | |
| 7,463,210 | B2 | 12/2008 | Rawnick | |
| 7,649,432 | B2 | 1/2010 | Sherrer et al. | |
| 7,656,256 | B2 | 2/2010 | Houck et al. | |
| 7,755,174 | B2 | 7/2010 | Rollin et al. | |
| 7,764,236 | B2 | 7/2010 | Hill | |
| 7,889,147 | B2 | 2/2011 | Tam | |
| 7,898,356 | B2 | 3/2011 | Sherrer et al. | |
| 7,948,335 | B2 | 5/2011 | Sherrer | |
| 8,325,093 | B2 | 12/2012 | Holland | |
| 9,130,262 | B2 | 9/2015 | Park | |
| 9,306,254 | B1 | 4/2016 | Hovey | |
| 10,008,779 | B2 | 6/2018 | Boryssenko | |
| 10,153,545 | B2 * | 12/2018 | Stratis | H01Q 3/26 |
| 10,199,722 | B2 * | 2/2019 | Stratis | H01Q 1/42 |
| 2003/0231134 | A1 | 12/2003 | Yarasi | |
| 2004/0119557 | A1 | 6/2004 | Barnes | |
| 2004/0263410 | A1 | 12/2004 | Teillet | |
| 2005/0013977 | A1 | 1/2005 | Wong | |
| 2005/0040994 | A1 | 2/2005 | Mazoki | |
| 2005/0116862 | A1 | 6/2005 | du Toit | |
| 2006/0232489 | A1 | 10/2006 | Bisiules | |
| 2007/0126651 | A1 | 6/2007 | Snyder | |
| 2008/0074339 | A1 | 3/2008 | Lee | |
| 2008/0079644 | A1 | 4/2008 | Cheng | |
| 2009/0051619 | A1 | 2/2009 | Hook | |
| 2009/0284419 | A1 | 11/2009 | Kim | |
| 2010/0007572 | A1 | 1/2010 | Jones | |
| 2010/0109819 | A1 | 5/2010 | Houck et al. | |
| 2010/0296252 | A1 | 11/2010 | Rollin et al. | |
| 2011/0025574 | A1 | 2/2011 | Tiezzi | |
| 2011/0057852 | A1 | 3/2011 | Holland | |
| 2011/0123783 | A1 | 5/2011 | Sherrer et al. | |
| 2011/0181376 | A1 | 7/2011 | Vanhille et al. | |
| 2011/0181377 | A1 | 7/2011 | Vanhille et al. | |
| 2011/0210807 | A1 | 9/2011 | Sherrer et al. | |
| 2011/0273241 | A1 | 11/2011 | Sherrer et al. | |
| 2012/0146869 | A1 | 6/2012 | Holland | |
| 2013/0002501 | A1 | 1/2013 | Li | |
| 2013/0169505 | A1 | 7/2013 | Shmuel | |
| 2014/0103423 | A1 | 4/2014 | Ohlsson | |
| 2014/0354500 | A1 | 12/2014 | Tayama | |
| 2015/0162665 | A1 | 6/2015 | Boryssenko | |
| 2016/0268695 | A1 | 9/2016 | Zavrel, Jr. | |
| 2016/0294035 | A1 | 10/2016 | Rollin | |
| 2016/0370568 | A1 | 12/2016 | Toussaint | |
| 2017/0025767 | A1 | 1/2017 | Elsallal | |
| 2017/0170592 | A1 | 6/2017 | Sherrer | |
| 2017/0256859 | A1 | 9/2017 | Boryssenko | |
| 2018/0323510 | A1 | 11/2018 | Boryssenko | |

FOREIGN PATENT DOCUMENTS

| | | |
|---|---|---|
| WO | 2007076105 | 7/2007 |
| WO | 2014011675 | 1/2014 |

OTHER PUBLICATIONS

Ghannoum, H. et al. "Probe Fed Stacked Patch Antenna for UWB Sectoral Applications," IEEE International Conference on Ultra-Wideband 2005. pp. 97-102.

A. Boryssenko, J. Arroyo, R. Reid, M.S. Heimbeck, "Substrate free G-band Vivaldi antenna array design, fabrication and testing" 2014 IEEE International Conference on Infrared, Millimeter, and Terahertz Waves, Tucson, Sep. 2014.

B. Cannon, K. Vanhille, "Microfabricated Dual-Polarized, W-band Antenna Architecture for Scalable Line Array Feed," 2015 IEEE Antenna and Propagation Symposium, Vancouver, Canada, Jul. 2015.

D. Filipovic, G. Potvin, D. Fontaine, C. Nichols, Z. Popovic, S. Rondineau, M. Lukic, K. Vanhille, Y. Saito, D. Sherrer, W. Wilkins, E. Daniels, E. Adler, and J. Evans, "Integrated micro-coaxial Ka-band antenna and array," GomacTech 2007 Conference, Mar. 2007.

E. Cullens, L. Ranzani, E. Grossman, Z. Popovic, "G-Band Frequency Steering Antenna Array Design and Measurements," Proceedings of the XXXth URSI General Assembly, Istanbul, Turkey, Aug. 2011.

Gao, S. et al. "A Broad-Band Dual-Polarized Microstrip Patch AntennaWith Aperture Coupling," IEEE Transactions on Antennas And Propagation, vol. 51, No. 4, Apr. 2003. pp. 898-900.

Gao, S.C., et al., Dual-polarised Wideband Microstrip Antenna, Electronic Letters, Aug. 30, 2001, vol. 37, No. 18, pp. 1106-1107.

Guo, Y.X. et al. "L-probe proximity-fed short-circuited patch antennas," Electronics Letters, vol. 35 No. 24, Nov. 25, 1999. pp. 2069-2070.

H. Zhou, N. A. Sutton, D. S. Filipovic, "Surface micromachined millimeter-wave log-periodic dipole array antennas," IEEE Trans. Antennas Propag., Oct. 2012, vol. 60, No. 10, pp. 4573-4581.

H. Zhou, N. A. Sutton, D. S. Filipovic, "Wideband W-band patch antenna," 5th European Conference on Antennas and Propagation , Rome, Italy, Apr. 2011, pp. 1518-1521.

Holzheimer, et al., Performance Enhancements with Applications of the Coaxial Cavity Antenna, pp. 171-193.

Hsu, Wen-Hsiu et al. "Broadband Aperture-Coupled Shorted-Patch Antenna," Microwave And Optical Technology Letters, vol. 28, No. 5, Mar. 5, 2001. pp. 306-307.

J. M. Oliver, J.-M. Rollin, K. Vanhille, S. Raman, "A W-band micromachined 3-D cavity-backed patch antenna array with integrated diode detector," IEEE Trans. Microwave Theory Tech., Feb. 2012, vol. 60, No. 2, pp. 284-292.

J. M. Oliver, P. E. Ralston, E. Cullens, L. M. Ranzani, S. Raman, K. Vanhille, "A W-band Micro-coaxial Passive Monopulse Comparator Network with Integrated Cavity-Backed Patch Antenna Array," 2011 IEEE MTT-S Int. Microwave, Symp., Baltimore, MD, Jun. 2011.

J. Mruk, Z. Hongyu, M. Uhm, Y. Saito, D. Filipovic, "Wideband mm-Wave Log-Periodic Antennas," 3rd European Conference on Antennas and Propagation, pp. 2284-2287, Mar. 2009.

J. R. Mruk, N. Sutton, D. S. Filipovic, "Micro-coaxial fed 18 to 110 GHz planar log-periodic antennas with RF transitions," IEEE Trans. Antennas Propag., vol. 62, No. 2, Feb. 2014, pp. 968-972.

J.R. Mruk, Y. Saito, K. Kim, M. Radway, D. Filipovic, "A directly fed Ku- to W-band 2-arm Archimedean spiral antenna," Proc. 41st European Microwave Conf., Oct. 2011, pp. 539-542.

K. M. Lambert, F. A. Miranda, R. R. Romanofsky, T. E. Durham, K. J. Vanhille, "Antenna characterization for the Wideband Instrument for Snow Measurements (WISM)," 2015 IEEE Antenna and Propagation Symposium, Vancouver, Canada, Jul. 2015.

K. Vanhille, M. Lukic, S. Rondineau, D. Filipovic, and Z. Popovic, "Integrated micro-coaxial passive components for millimeter-wave antenna front ends," 2007 Antennas, Radar, and Wave Propagation Conference, May 2007.

(56) References Cited

OTHER PUBLICATIONS

L. Ranzani, N. Ehsan, Z. Popovic, "G-band frequency-scanned antenna arrays," 2010 IEEE APS-URSI International Symposium, Toronto, Canada, Jul. 2010.
M. Lukic, D. Fontaine, C. Nichols, D. Filipovic, "Surface micromachined Ka-band phased array antenna," Presented at Antenna Applic. Symposium, Monticello, IL, Sep. 2006.
M. Lukic, K. Kim, Y. Lee, Y. Saito, and D. S. Filipovic, "Multi-physics design and performance of a surface micromachined Ka-band cavity backed patch antenna," 2007 SBMO/IEEE Int. Microwave and Optoelectronics Conf., Oct. 2007, pp. 321-324.
M. V. Lukic, and D. S. Filipovic, "Integrated cavity-backed ka-band phased array antenna," Proc. IEEE-APS/URSI Symposium, Jun. 2007, pp. 133-135.
M. V. Lukic, and D. S. Filipovic, "Surface-micromachined dual Ka-band cavity backed patch antenna," IEEE Trans. Antennas Propag., vol. 55, No. 7, pp. 2107-2110, Jul. 2007.
Mruk, J.R., Saito, Y, Kim, K., Radway, M., Filipovic, D.S., "Directly fed millimetre-wave two-arm spiral antenna," Electronics Letters, Nov. 25, 2010, vol. 46 , issue 24, pp. 1585-1587.
N. Chamberlain, M. Sanchez Barbetty, G. Sadowy, E. Long, K. Vanhille, "A dual-polarized metal patch antenna element for phased array applications," 2014 IEEE Antenna and Propagation Symposium, Memphis, Jul. 2014. pp. 1640-1641.
N. Jastram, D. S. Filipovic, "Parameter study and design of W-band micromachined tapered slot antenna," Proc. IEEE-APS/URSI Symposium, Orlando, FL, Jul. 2013, pp. 434-435.
N. Sutton, D.S. Filipovic, "Design of a K- thru Ka-band modified Butler matrix feed for a 4-arm spiral antenna," 2010 Loughborough Antennas and Propagation Conference, Loughborough, UK, Nov. 2010, pp. 521-524.
N.A. Sutton, D. S. Filipovic, "V-band monolithically integrated four-arm spiral antenna and beamforming network," Proc. IEEE-APS/URSI Symposium, Chicago, IL, Jul. 2012, pp. 1-2.
Nakano, M., et al., "Feed Circuits of Double-Layered Self-Diplexing Antenna for Mobile Satelite Communications", Transactions on Antennas and Propagation, vol. 40, No. 1, Oct. 1992, pp. 1269-1271.
Oliver, J.M. et al., "A3-D micromachined W-band cavity backed patch antenna array with integrated rectacoax transition to wave guide," 2009 Proc. IEEE International Microwave Symposium, Boston, MA 2009.
Sevskiy, S. and Wiesbeck, W, "Air-Filled Stacked-Patch Antenna," ITG-Fachberichte. No. 178, (2003). pp. 53-56.
T. E. Durham, C. Trent, K. Vanhille, K. M. Lambert, F. A. Miranda, "Design of an 8-40 GHz Antenna for the Wideband Instrument for Snow Measurements (WISM)," 2015 IEEE Antenna and Propagation Symposium, Vancouver, Canada, Jul. 2015.
Tim Holzheimer, Ph.D., P ,E., The Low Dispersion Coaxial Cavity as an Ultra Wideband Antenna, 2002 IEEE Conference on Ultra Wideband Systems and Technologies, pp. 333-336.
Vallecchi, A. et al. "Dual-Polarized Linear Series-Fed Microstrip ArraysWith Very Low Losses and Cross Polarization," IEEE Antennas And Wireless Propagation Letter, vol. 3, 2004. pp. 123-126.
Y. Saito, J.R. Mruk, J.-M. Rollin, D.S. Filipovic, "X- through Q-band log-periodic antenna with monolithically integrated u-coaxial impedance transformer/feeder," Electronic Letts. Jul. 2009, pp. 775-776.
Y. Saito, M.V. Lukic, D. Fontaine, J.-M. Rollin, D.S. Filipovic, "Monolithically Integrated Corporate-Fed Cavity-Backed Antennas," IEEE Trans. Antennas Propag., vol. 57, No. 9, Sep. 2009, pp. 2583-2590.
Z. Popovic, "Micro-coaxial micro-fabricated feeds for phased array antennas," in IEEE Int. Symp. on Phased Array Systems and Technology, Waltham, MA, Oct. 2010, pp. 1-10. (Invited).
Zurcher, J. "Broadband Patch Antennas," Chapter 3, 1995. pp. 45-61.
Ben Munk et al.; "A Low-Profile Broadband Phased Array Antenna"; The Ohio State University ElectroScience Laboratory, Dept. of Electrical Engineering; 2003 pp. 448-451.
Woorim Shin, et al. "A 108-114 GHz 4 4 Wafer-Scale Phased Array Transmitter With High-Efficiency On-Chip Antennas"; IEEE Journal of Solid-State Circuits, vol. 48, No. 9, Sep. 2013.
Harold A. Wheeler; "Simple Relations Derived from a Phased-Array Antenna Made of an Infinite Current Sheet"; IEEE Transactions on Antennas Propagation; Jul. 1965; pp. 506-514.
E. G. Magill, et al.; Wide-Angle Impedance Matching of a Planar Array Antenna by a Dielectric Sheet; IEEE Transactions on Antennas Propagation; Jan. 1966; vol. AP-14 No. 1; pp. 49-53.
P. W. Hannan, et al.; Impedance Matching a Phased-Array Antenna Over Wide Scan Angles by Connecting Circuits; Impedance Matching a Phased-Array Antenna; Jan. 1965 pp. 28-34.
James E. Dudgeon, et al.;Microstrip Technology And Its Application to Phased Array Compensation; Jan. 21, 1972; pp. 1-81.
Kerry Speed, et al; Progress on the 8-40 GHz Wideband Instrument for Snow Measurements(WISM); Harris.com Earth Science Tech nology Forum 2014 Oct. 28-30, 2014 Leesburg, VA; pp. 1-36.
Mark Jones, et al.; A New Approach To Broadband Array Design Using Tightly Coupled Elements; IEEE; 2007; pp. 1-7.
W. M. Qureshi,, et al., Fabrication of a Multi-Octave Phased Array Aperture; 6th EMRS DTC Technical Conference—Edinburgh; 2009; pp. 1-5.
John Forrest McCann, B.S.; On The Design Of Large Bandwidth Arrays Of Slot Elements With Wide Scan Angle Capabilities; Thesis The Ohio State University; 2006; pp. 1-102.
Tengfei Xia,, et al.; Design of a Tapered Balun for Broadband Arrays With Closely Spaced Elements; IEEE Antennas And Wireless Propagation Letters, vol. 8, 2009; pp. 1291-1294.
Justin A. Kasemodel, et al.; A Miniaturization Technique for Wideband Tightly Coupled Phased Arrays; IEEE; 2009; pp. 1-4.
Elias A. Alwan,, et al.; A Simple Equivalent CircuitModel for Ultrawideband Coupled Arrays; IEEE Antennas And Wireless Propagation Letters, vol. 11, 2012; pp. 117-120.
Nathanael J. Smith; Development Of A 180° Hybrid Balun To Feed A Tightly Coupled Dipole X-Band Array; The Ohio State University 2010; pp. 1-52.
Justin A. Kasemodel; Realization Of A Planar Low-Profile Broadband Phased Array Antenna; Dissertation, The Ohio State University 2010; pp. 1-120.
Justin A. Kasemodel, et al.; Low-Cost, Planar and Wideband Phased Array with Integrated Balun and Matching Network for Wide-Angle Scanning; IEEE 2010; pp. 2-4.
Erdinc Irci; Low-Profile Wideband Antennas Based on Tightly Coupled Dipole and Patch Elements; Dissertation, The Ohio State University 2011; pp. 1-126.
William F. Moulder; Novel Implementations of Ultrawideband Tightly Coupled Antenna Arrays; Dissertation, The Ohio State University 2012; pp. 1-133.
Ioannis Tzanidis; Ultrawideband Low-Profile Arrays of Tightly Coupled Antenna Elements: Excitation, Termination and Feeding Methods; Dissertation, The Ohio State University 2011; pp. 1-189.
Jonathan Doane; Wideband Low-Prole Antenna Arrays: Fundamental Limits and Practical Implementations; Dissertation, The Ohio State University 2013; pp. 1-265.
Justin A. Kasemodel et al.; Wideband Planar Array With Integrated Feed and Matching Network for Wide-Angle Scanning; IEEE Transactions On Antennas And Propagation, vol. 61, No. 9, Sep. 2013; pp. 4528-4537.
Jonathan P. Doane, et al.; Wideband, Wide Scanning Conformal Arrays with Practical Integrated Feeds; Proceedings of the "2013 International Symposium on Electromagnetic Theory"; pp. 859-862.
Steven S. Holland, et al.; Design and Fabrication of Low-Cost PUMA Arrays; IEEE; 2011; pp. 1976-1979.
Steven S. Holland; Low-Profile, Modular, Ultra-Wideband Phased Arrays; Dissertation, University of Massachusetts; Sep. 2011; pp. 1-327.
John T. Logan, et al.; A Review of Planar Ultrawideband Modular Antenna (PUMA) Arrays; Proceedings of the "2013 International Symposium on Electromagnetic Theory"; 2013; pp. 868-871.
D. Cavallo, et al.; Common-Mode Resonances in Ultra Wide Band Connected Arrays of Dipoles: Measurements from the Demonstrator and Exit Strategy; IEEE; 2009; pp. 435-438.

(56) References Cited

OTHER PUBLICATIONS

J. J. Lee, et al.; Performance of a Wideband (3-14 GHz) Dual-pol Array; IEEE; 2004; pp. 551-554.
Jian Bai, et al.; Ultra-wideband Slot-loaded Antipodal Vivaldi Antenna Array; IEEE; 2011; pp. 79-81.
E. Garca I, et al.; Elimination Of Scan Impedance Anomalies In Ultra-Wide Band Phased Arrays Of Differentially Fed Tapered Slot Antenna Elements; IEEE; 2008; pp. 1-4.
Eloy de Lera Acedo, et al.; Study and Design of a Differentially-Fed Tapered Slot Antenna Array; IEEE Transactions On Antennas And Propagation, vol. 58, No. 1, Jan. 2010; pp. 68-78.
Y. Chen, et al.; A Novel Wideband Antenna Array With Tightly Coupled Octagonal Ring Elements; Progress In Electromagnetics Research, vol. 124, 55-70; 2012.
J. Y. Li; Design Of Broadband Compact Size Antenna Comprised Of Printed Planar Dipole Pairs; Progress In Electromagnetics Research Letters, vol. 12, 99-109; 2009.
Mats Gustafsson; Broadband array antennas using a self-complementary antenna array and dielectric slabs; CODEN:LUTEDX/(TEAT-7129)/1-8; Dec. 13, 2004.
Terry Richard Vogler; Analysis of the Radiation Mechanisms in and Design of Tightly-Coupled Antenna Arrays; Dissertation, Virginia Polytechnic Institute and State University; Sep. 10, 2010; pp. 1-251.
S. G. Hay, et al.; Analysis of common-mode effects in a dual-polarized planar connected-array antenna; Radio Science, vol. 43, RS6S04, doi:10.1029/2007RS003798; 2008.
A. Chippendale,, et al.; Chequerboard Phased Array Feed Testing for ASKAP; May 3, 2010; pp. 1-41.
Yan Fei, et al.; A Simple Wideband Dual-Polarized Array With Connected Elements; University of Electronic Science and Technology of China (UESTC); 2013; pp. 1-21.
Fei Yan, et al. ; A Simple Wideband Dual-Polarized Array With Connected Elements; Institute of Applied Physics and Computational Mathematics; 978-1-4673-5317-5/13 2013 IEEE.
Tomasz Michna, et al.; Characterization of an Impulse-Transmitting UWB Antenna Array with Dispersive Feed Network; Characterization of an Impulse-Transmitting UWB; 2008; pp. 59-62. Antenna Array with Dispersive Feed Network.
Martin Wagner, et al.; Multi-B and Polarizat ion-Ver satile Array Antenna for Smart Antenna Applications in Cellular Systems; 2004 EEE MTT-S Digest; pp. 1769-1772.
Jeremie Bourqui, et al.; Balanced Antipodal Vivaldi Antenna With Dielectric Director for Near-Field Microwave Imaging; EEE Transactions on Antennas and Propagation, vol. 58, No. 7; Jul. 2010.
R.N. Simons, et al.; Impedance matching of tapered slot antenna using a dielectric transformer; Electronics Letters Nov. 26, 1998 vol. 34 No. 24.
S. A. Adamu, et al.; Review On Gain and Directivity Enhancement Techniques of Vivaldi Antennas; International Journal of Scientific & Engineering Research, vol. 8, Issue 3, Mar. 2017; ISSN 2229-5518.
S. Livingston, et al.; Evolution of Wide Band Array Designs; 2011; IEEE pp. 1957-1960.
J. J. Lee,W et al.; Wide Band Long Slot Array Antennas; IEEE; 2003; pp. 452-455.
Johnson J. H. Wang; A New Planar Multioctave Broadband Traveling-Wave Beam-Scan Array Antenna; Wang Electro-Opto Corporation; 2007; pp. 1-4.
John Toon; New planar design allows fabrication of ultra-wideband, phased-array antennas; 100-to-1 Bandwidth @ Winter 2006; pp. 18-19.
Hans Steyskal, et al.; Design of Realistic Phased Array Patch Elements Using a Genetic Algorithm; Air Force Research Laboratory; 2010; pp. 246-252.
Benjamin Riviere, et al.; Ultrawideband Multilayer Printed Antenna Arrays With Wide Scanning Capability; 2015; IEEE; 514-515.
Boryssenko, et al.; A Matlab Based Universal CEM CAD Optimizer; 2012; IEEE International Symposium on Antennas and Propagation; pp. 1-25.
Justin A. Kasemodel, et al.; A Novel Non-Symmetric Tightly Coupled Element For Wideband Phased Array Apertures; Dissertation The Ohio State University; 2010; pp. 1-13.
Markus H. Novak, et al.; Ultra-Wideband Phased Array Antennas for Satellite Communications upto Ku- and Ka-Band; May 2015; pp. 1-6.
Wajih Elsallal, et al.; Charateristics of Decade-bandwidth, Balanced Antipodal Vivaldi Antenna (BAVA) Phased Arrays with Time-Delay Beamformer Systems; IEEE International Symposium on Phased Array Systems and Technology.
Michel Arts, et al.; Broadband Differentially Fed Tapered Slot Antenna Array for Radio Astronomy Applications; 2009; 3rd European Conference on Antennas and Propagation; pp. 1-5.
Yongwei Zhang, et al.; Octagonal Ring Antenna for a Compact Dual-Polarized Aperture Array; IEEE Transactions on Antennas and Propagation, vol. 59, No. 10, Oct. 2011; pp. 3927-3932.
Hisao Iwasaki, et al.; A Circularly Polarized Microstrip Anfenna Using Singly-Fed Proximity Coupled Feed; Proceedings of ISAP '92, Sapporo, Japan; pp. 797-800.
Hansen, Robert C. Phased array antennas. vol. 213. John Wiley & Sons, 2009.
Herd, J., and S. Duffy. "Overlapped digital subarray architecture for multiple beam phased array radar." Proceedings of the 5th European Conference on Antennas and Propagation (EUCAP). IEEE, 2011.
L. Ranzani, D. Kuester, K. J. Vanhille, A. Boryssenko, E. Grossman and Z. Popovic, "G-band Micro-fabricated Frequency-steered Arrays with 2deg/GHz Beam Steering," IEEE Transactions on Terahertz Science and Technology, vol. 3, No. 5, Sep. 2013.
Kindt, Rick W., and W. Raymond Pickles. All-Metal Flared-Notch Array Radiator for Ultrawideband Applications. No. NRL/MR/5310-10-9279. Naval Research Lab Washington DC Radar Analysis Branch, 2010.
Doane, Jonathan P., Kubilay Sertel, and John L. Volakis. "A wideband, wide scanning tightly coupled dipole array with integrated balun (TCDA-IB)." IEEE Transactions on Antennas and Propagation 61.9 (2013): 4538-4548.
Moulder, William F., Kubilay Sertel, and John L. Volakis. "Superstrate-enhanced ultrawideband tightly coupled array with resistive FSS." IEEE Transactions on Antennas and Propagation 60.9 (2012): 4166-4172.
Papantonis, Dimitrios K., and John L. Volakis. "Dual-polarization TCDA-IB with substrate loading." 2014 IEEE Antennas and Propagation Society International Symposium (APSURSI). IEEE, 2014.
Herd, J., et al. "Multifunction Phased Array Radar (MPAR) for aircraft and weather surveillance." 2010 IEEE Radar Conference. IEEE, 2010.
J. D. Dyson, "The equiangular spiral antenna," Wright Air Development Center, 1957.
Frank B. Gross; Ultra-wideband antenna arrays—The basics—Part I; Apr. 7, 2011.
The ARRL Atenna Book, by Gerald Hall (Year: 1988).
Office Action dated Nov. 8, 2018 for U.S. Appl. No. 15/373,016 (pp. 1-20).

* cited by examiner

MULTI-ELEMENT ANTENNA CONFORMED TO A CONICAL SURFACE

This application claims the benefit of priority of U.S. Provisional Application No. 62/897,532, filed on Sep. 9, 2019, the entire contents of which application(s) are incorporated herein by reference.

GOVERNMENT LICENSE RIGHTS

This invention was made with government support under Contract No. W31P4Q-17-C-0051 awarded by identify the United States Army. The government has certain rights in the invention.

FIELD OF THE INVENTION

The present invention relates generally to multi-element antennas and more particularly but not exclusively to multi-element antennas conformed to a conical surface and associated feed structures.

SUMMARY OF THE INVENTION

In one of its aspects the present invention may be useful in weapon systems by providing an RF seeker antenna usable in low-cost smart munitions fired as artillery (projectiles) with the seeker antenna capable of surviving harsh environmental conditions. In one exemplary configuration, a 40-mm projectile is shown notionally, but the present invention can be adapted to fit larger or smaller diameter projectile platforms and can operate at various seeker frequencies of interest.

For example, the present invention may provide an antenna feed/beamformer electromagnetically coupled to a plurality of leaky dielectric-loaded waveguides which change shape in both theta and phi as they extend towards the tip (z-axis is boresight) of the projectile. The top surface of the waveguides may be leaky to quasi-guided radio frequencies and may be exposed to the operating environment. An exemplary configuration may include coupling slots each one feeding a respective waveguide from a waveguide end furthest from the tip (i.e., an aft end); however, other feeding structures such as a monopole e-field probe could be used to feed the back of the dielectric-loaded waveguide. The energy that leaks out of each dielectric-loaded waveguide may collimate and radiate predominantly towards the projectile's boresight. The leaky dielectric-loaded waveguides and electrically conductive nosecone can be made from high temperature materials and the analog/digital electronics can be moved aft, away from elevated temperatures that exist at the tip of the projectile during flight. Received energy from individual antenna elements (the waveguides) can be digitized directly and used to perform direction of arrival estimation. Furthermore, a compact analog beamformer can be connected to the leaky dielectric-loaded waveguides to form circular modes which are digitized and used to perform direction of arrival estimation. In a further configuration, the antenna may include a dielectric-loaded waveguide at the tip of the projectile which operates in conjunction with the leaky dielectric-loaded waveguides to provide the antenna. The dielectric-loaded waveguide at the tip may transmit a high power signal radiated therefrom, and a reflected signal may be received by the leaky dielectric-loaded waveguides.

BRIEF DESCRIPTION OF THE DRAWINGS

The foregoing summary and the following detailed description of exemplary embodiments of the present invention may be further understood when read in conjunction with the appended drawings, in which.

DETAILED DESCRIPTION OF THE INVENTION

Figure 1A:
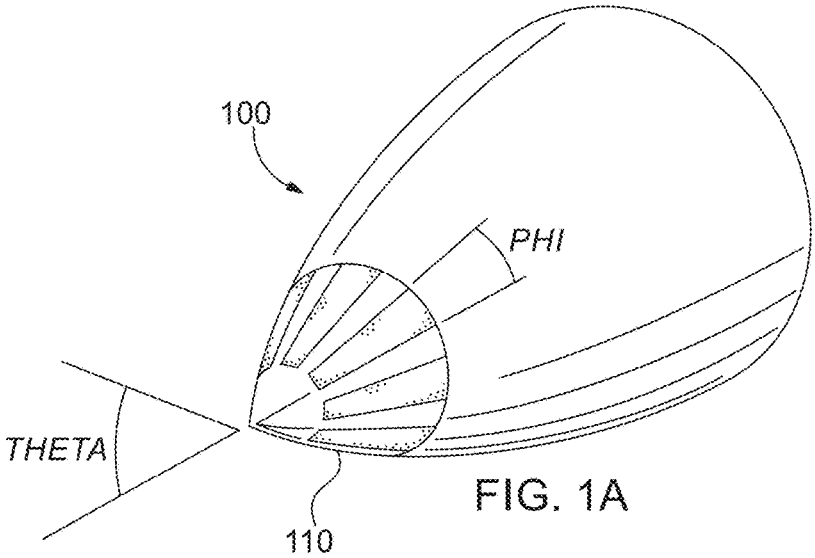
FIGS. 1A, 1B schematically illustrate an isometric and exploded view, respectively, of an exemplary configuration of an antenna integrated into a compact conical nosecone in accordance with the present invention, with the stippled areas corresponding to a dielectric-loaded material and the non-stippled corresponding to metal.
Figure 1B:
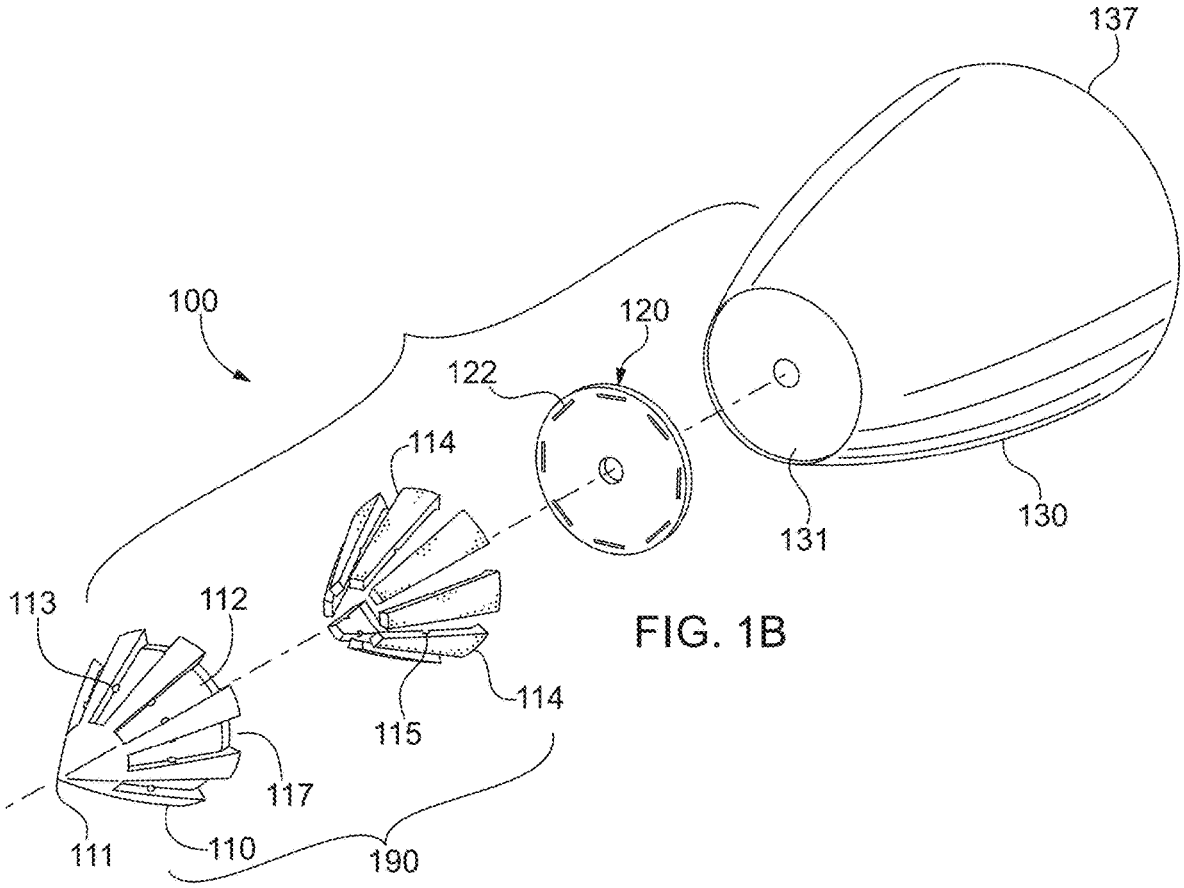

Referring now to the figures, wherein like elements are numbered alike throughout, an exemplary antenna 190 integrated into a compact conical-, ogive-, Von Karman-, etc.

shaped nosecone assembly 100 is illustrated, FIGS. 1A, 1B. The nosecone assembly 100 may include a nosecone 110 and adjoining nosecone body 130 with forward and aft ends 131, 137, respectively, which body 130 may house electronics and other components not related to the antenna 190. The assembly 100 may include a nosecone 110 which houses the radiating antenna elements, namely leaky dielectric-loaded waveguides 114. The leaky dielectric-loaded waveguides 114 may be seated in corresponding recesses 112 provided in the nosecone 110. To assist in retaining the dielectric-loaded waveguides 114 in the nosecone 110, tabs 113 may be provided in the recesses 112 for mating to corresponding detents 115 in the waveguides 114, FIGS. 1B, 10-12B. In addition, the tabs 113, as well as nubs, baffles, apertures, perforations, discontinuities, etc., can be utilized throughout the dielectric waveguides 114 to perturb the RF energy associated with the excited/guided modes and achieve the desired radiation and input impedance characteristics.

The leaky dielectric-loaded waveguides 114 may extend from an aft end 117 of the nosecone 110 towards an opposing tip 111 disposed along the longitudinal axis of the assembly 100. The waveguides 114 may extend a distance less than the length of the nosecone 110 so that the nosecone tip 111 does not contain the leaky dielectric-loaded waveguides 114, but rather the tip 111 comprises the material of the nosecone 110, such as metal. The dielectric-loaded waveguides 114 and nosecone 110 are designed to fit together such that when assembled with the waveguides 114 in place, the exposed surface of the waveguides 114 form a continuous smooth surface without gaps or openings with the adjacent surfaces of the nosecone 110, FIGS. 1A, 14.

The waveguides 114 are designed such that energy leaks out of the top surface of the dielectric-loaded waveguides 114 and a single antenna (waveguide) element radiates energy to predominately towards a boresight, which utilizes a feed structure to transition the energy from a beamformer assembly 120 or other RF array processing to the leaky dielectric-loaded waveguides 114. The dielectric filling can be homogenous or a heterogenous mixture of multiple dielectrics. The dielectric waveguides can be constructed from multiple dielectric materials which can be stratified/pixelated in any orientation.

Regarding the illustrated configurations of the dielectric-loaded waveguides 114, the dielectric waveguide 114 may have an approximately rectangular shape with four sides having conductive walls, one side open to free space and one side connected to the feed structure. At the input, the waveguide 114 may be approximately 1.5 lambda wide and 0.5 lambda thick, with respect to a free-space wave in a homogenous dielectric of 9.4. The waveguide may taper down in size to approximately 0.6 lambda and 0.3 lambda, respectively. The exact shape can have tapered/shaped walls to better support physical integration. Exact dimensions and the rate of taper may be optimized to achieve desired properties. All surfaces of the waveguides 114 may be metallized, excluding the outer surface exposed to the environment and the aft surface coupled to the beamformer assembly 120 or other RF array processing, FIG. 11, where the stippled areas correspond to the dielectric and the non-stippled correspond to metal. (The outer surface of the leaky dielectric-loaded waveguide 114 is non-metallized and exposed to the air, FIG. 1B.)

Figure 8A:
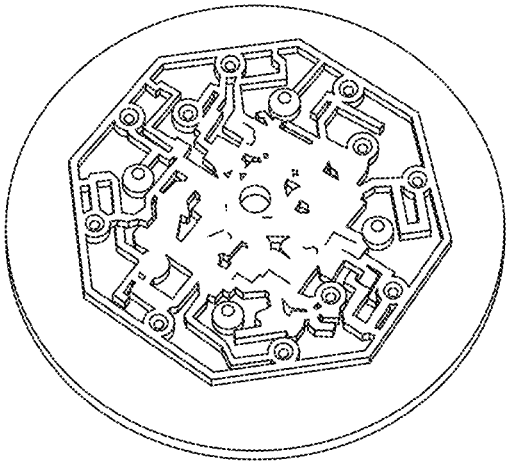
FIGS. 8A-8C illustrate a prototype of the monolithically fabricated beamformer of FIG. 1B.
Figure 8B:
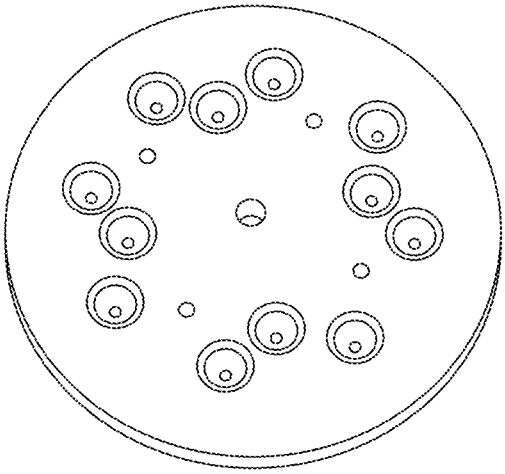
Figure 8C:
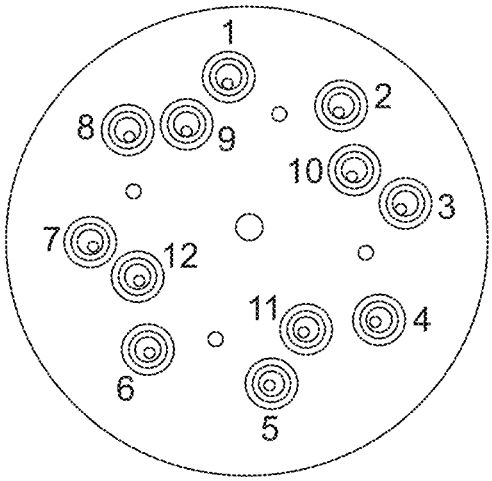

The beamformer assembly 120 may include a plurality (e.g., eight) individual feed transitions 124 each having a coupling slot 122 monolithically integrated therein and may be fabricated using PolyStrata® technology. (Examples of PolyStrata® processing/technology are illustrated in U.S. Pat. Nos. 7,948,335, 7,405,638, 7,148,772, 7,012,489, 7,649,432, 7,656,256, 7,755,174, 7,898,356 and/or U.S. Application Pub. Nos. 2010/0109819, 2011/0210807, 2010/0296252, 2011/0273241, 2011/0123783, 2011/0181376, 2011/0181377, each of which is incorporated herein by reference in their entirety). The disclosed conformal antenna is not limited to 8 radiating antenna elements. The simplest embodiment would likely possess two radiating elements, i.e. leaky dielectric-loaded waveguide radiators 114, and the upper end is limited by the number of radiating elements that can be packaged around the nosecone 110. The feed concept can be seen in FIGS. 1B, 4, 7A, 13 where the PolyStrata® beamformer assembly 120 directly feeds (with the coupling slot 122 monolithically integrated within the feed transition 124 and assembly beamformer assembly 120) 8 dielectric-loaded waveguides 114 which taper in both theta and phi as they extend towards the tip. FIG. 8A-8C illustrate a beamformer assembly 120 as fabricated.

Figure 2A:
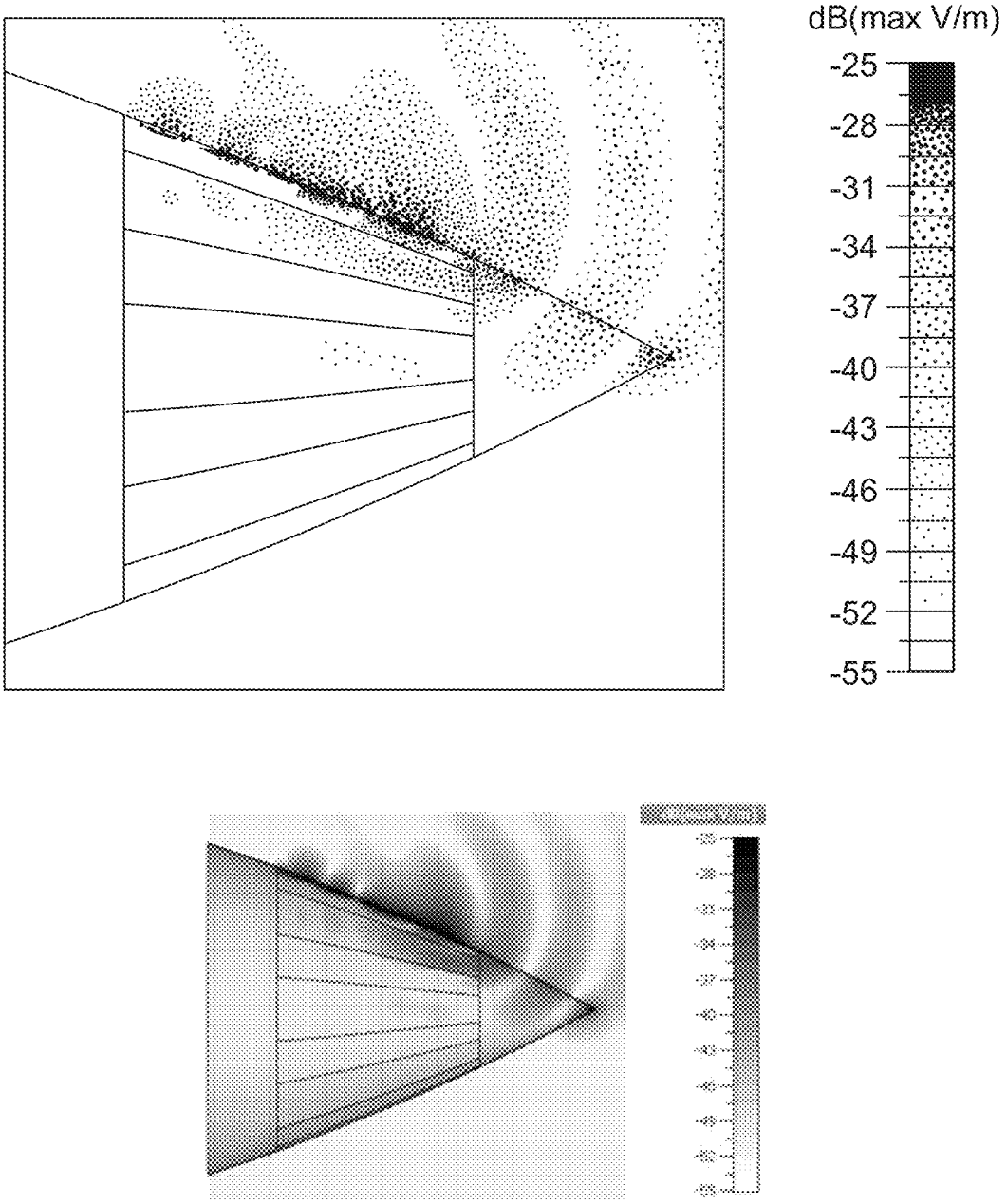
FIGS. 2A, 2B illustrate simulated nearfield and directivity plots associated with a single leaky dielectric-loaded waveguide of FIGS. 1A, 1B at 35 GHz.
Figure 2B:
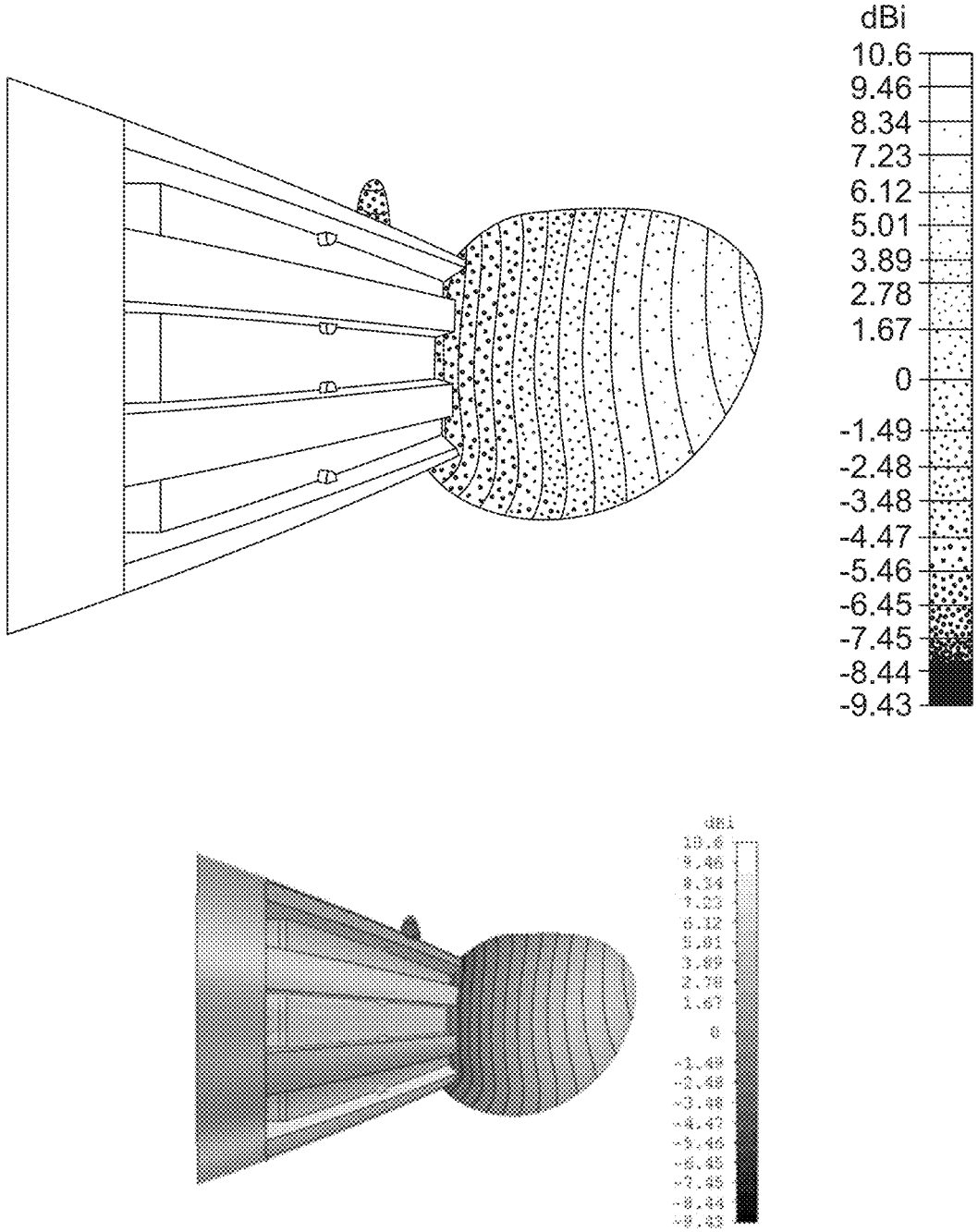

Near-field and far-field directivity plots associated with a single radiating dielectric-loaded waveguide 114 at 35 GHz is shown in FIGS. 2A, 2B. The dielectric-loaded waveguide 114 with its top surface open to free space behaves as a leaky-wave antenna where energy leaks out as it propagates down the antenna element. A goal is to transition all the energy to the outer surface of the dielectric-loaded waveguides 114 with such a phase gradient that the energy steers to the boresight. As shown in the near field and far field plots, FIGS. 2A, 2B, the design sends most of the energy down the length of the airframe.

Figure 3A:
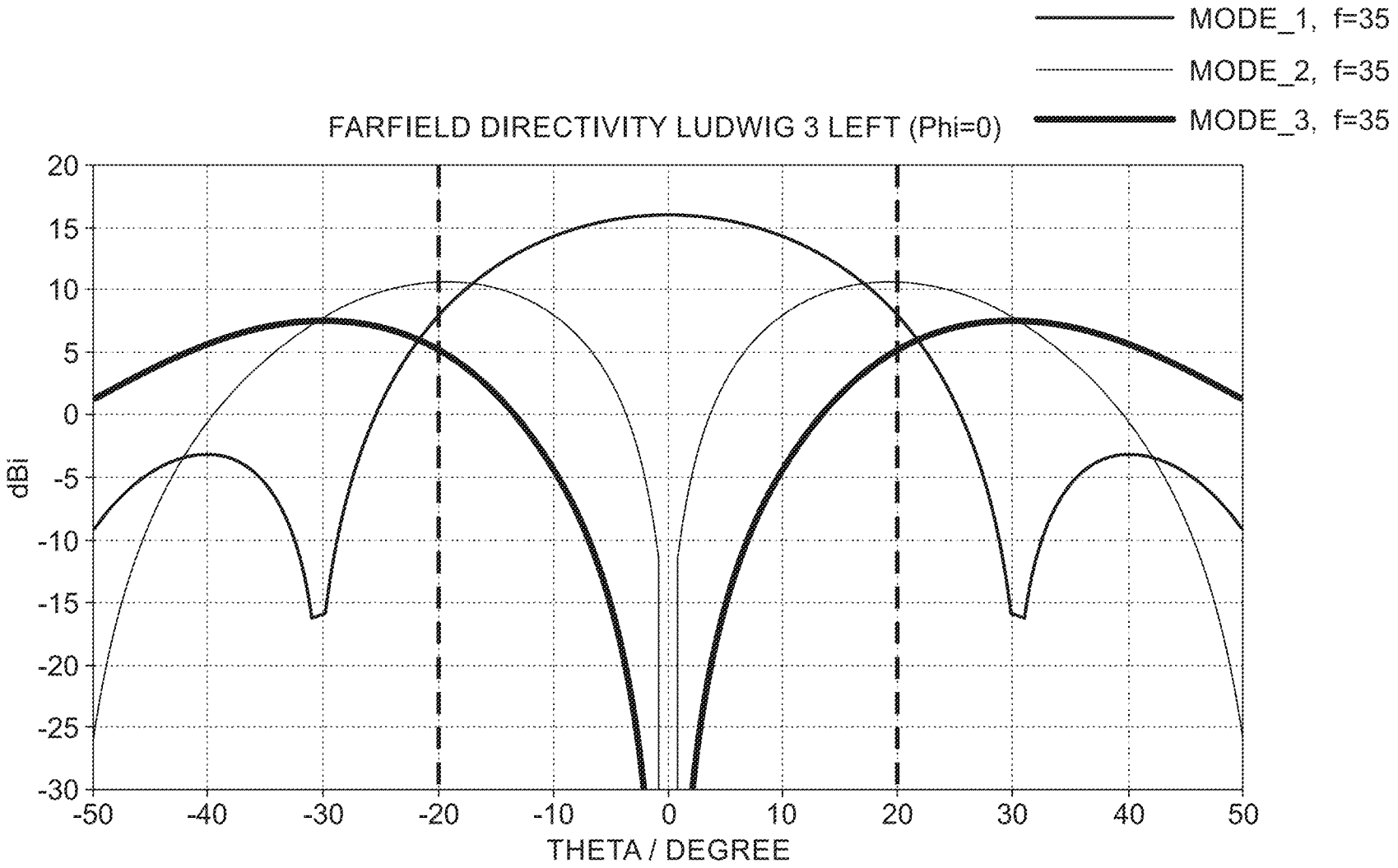
FIGS. 3A, 3B illustrate directivity plots associated with applying circular mode theory phasing to all eight leaky dielectric-loaded waveguides of FIGS. 1A, 1B at 35 GHz.
Figure 3B:
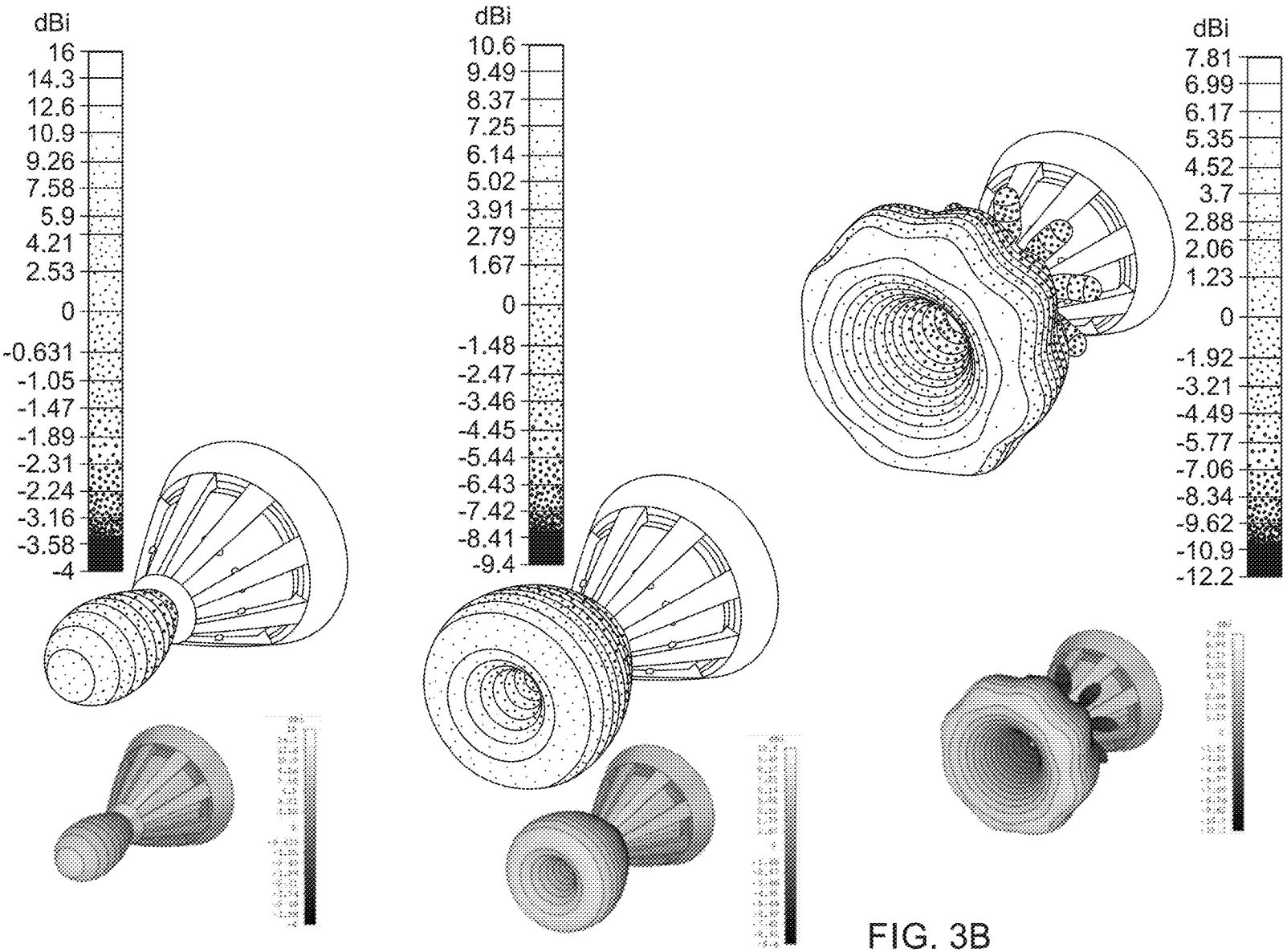
Figure 14:
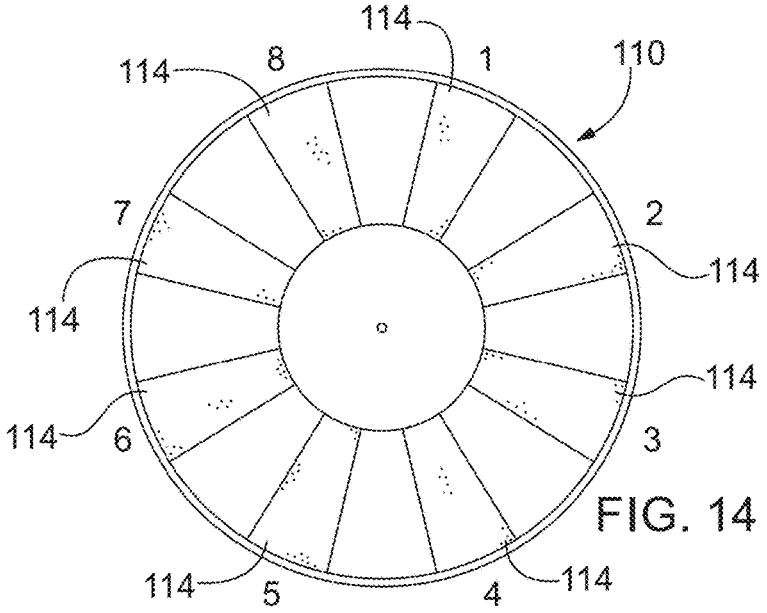
FIG. 14 schematically illustrates an end view of the nosecone of FIG. 1A.
Figure 15A:
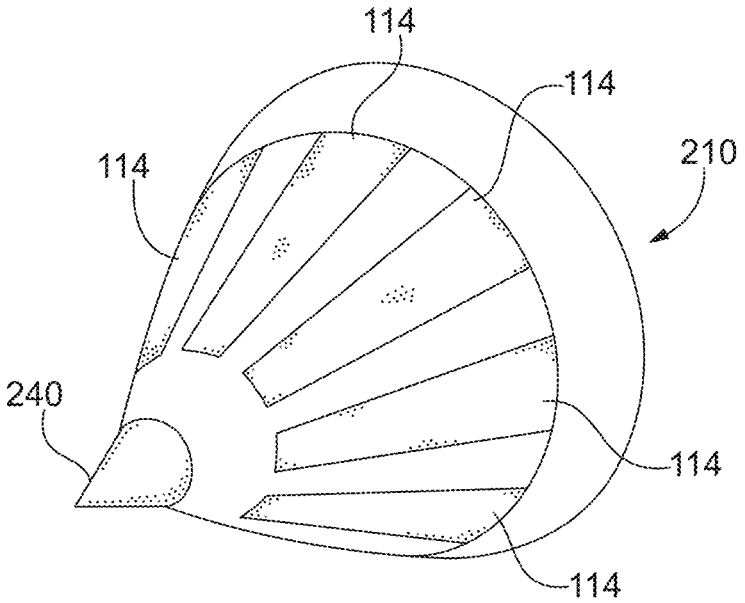
FIGS. 15A, 15B schematically illustrate a further exemplary configuration of an antenna integrated into a compact conical nosecone in accordance with the present invention, having a transmit antenna which radiates from nosecone tip and is fed through the center of the nosecone by a circular dielectric waveguide.
Figure 15B:
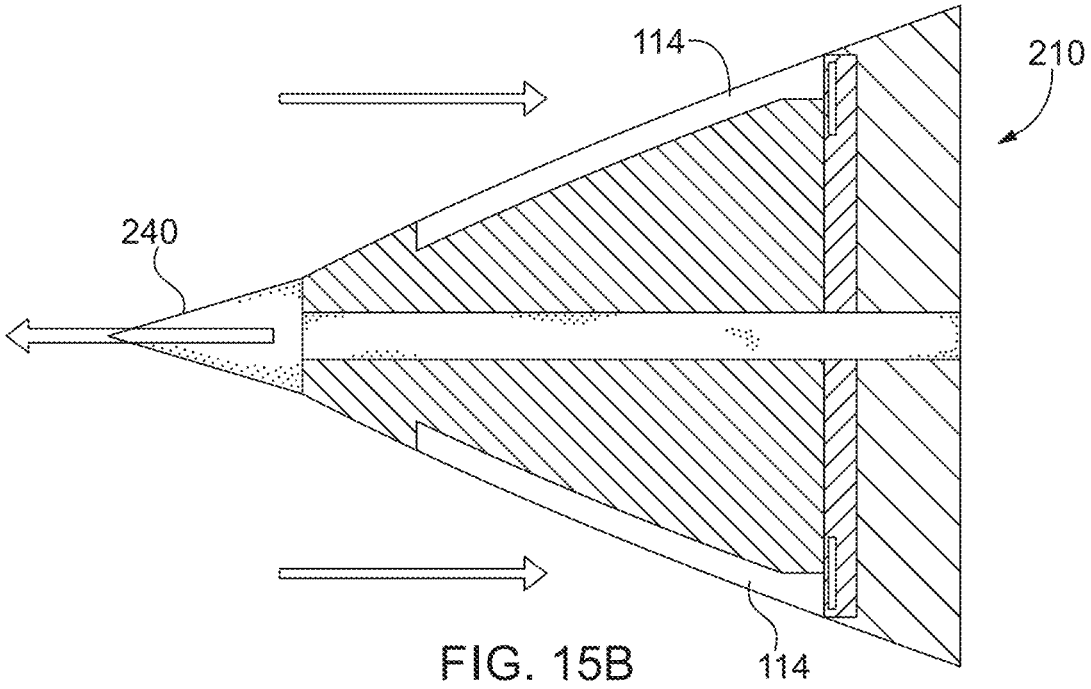

In one of its aspects the present invention takes the single waveguide 114 result and arrays 8 of waveguides 114 in phi with the proper phasing to create circular modes 1, 2, and 3, FIG. 14, Table 1. The results are captured in FIGS. 3A, 3B.

TABLE 1

Phasing of Antenna Elements

| Ring Array Element # | Mode 1 | Mode 2 | Mode 3 |
|---|---|---|---|
| 1 | 0 | 0 | 0 |
| 2 | 45 | 90 | 135 |
| 3 | 90 | 180 | 270 |
| 4 | 135 | 270 | 405 |
| 5 | 180 | 360 | 540 |
| 6 | 225 | 450 | 675 |
| 7 | 270 | 540 | 810 |
| 8 | 315 | 630 | 945 |

Table 2 captures the antenna and beamformer goals. An electromagnetic (EM) prototype of an antenna in accordance with the present invention as designed, fabricated and validated with measurements, FIGS. 1A, 1B.

TABLE 2

Design Targets - Electrical

| | Type | Value | Units |
|---|---|---|---|
| Target Frequency | Nominal | 35 | GHz |
| Total Frequency Bandwidth | Range | 34-36 | GHz |
| Antenna: | | | |
| Return Loss | Greater than | 10 | dB |
| Insertion Loss | Less than | 1 | dB |

Figure 4A:
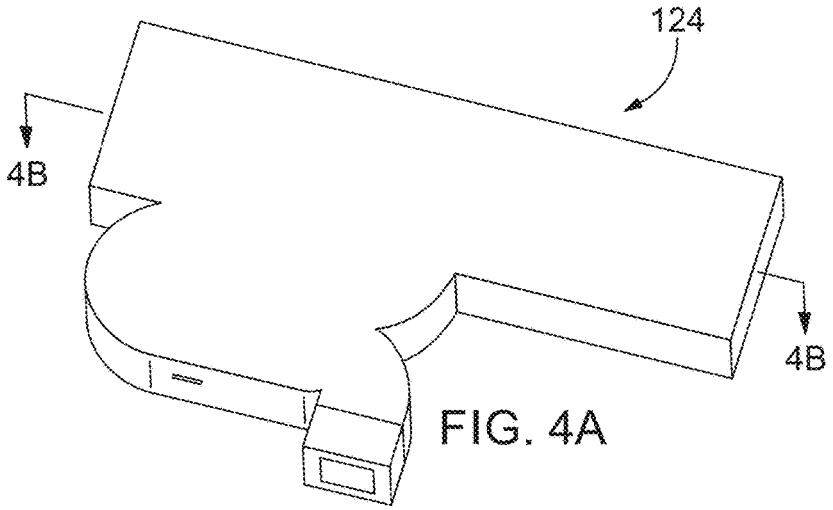
FIGS. 4A-4C schematically illustrate an exemplary Poly-Strata® build implementation of a waveguide slot transition in accordance with the present invention, with FIG. 4A showing an isometric top view, FIG. 4B showing a cross-sectional view of FIG. 4A, and FIG. 4C an isometric bottom view showing the waveguide slot.
Figure 4B:
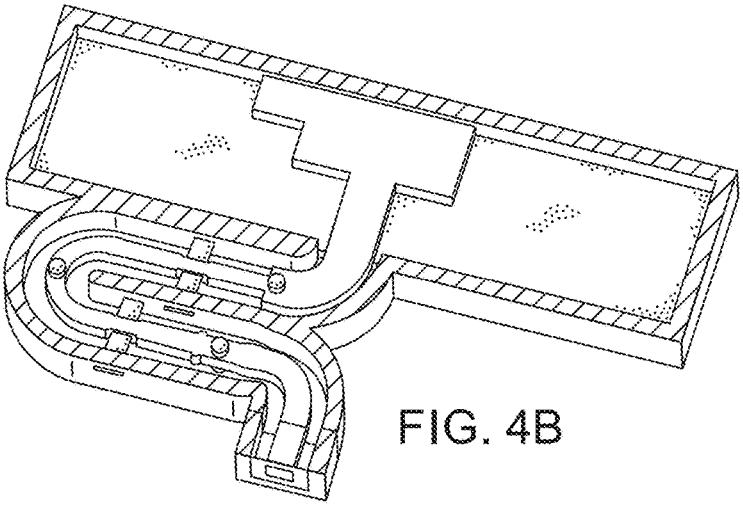
Figure 4C:
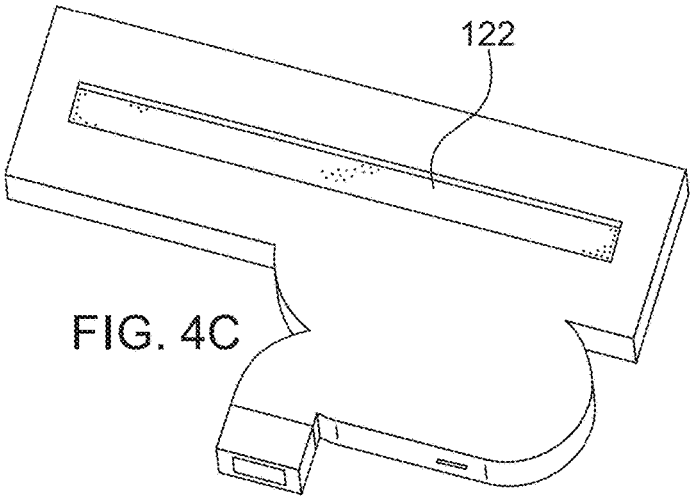
Figure 5:
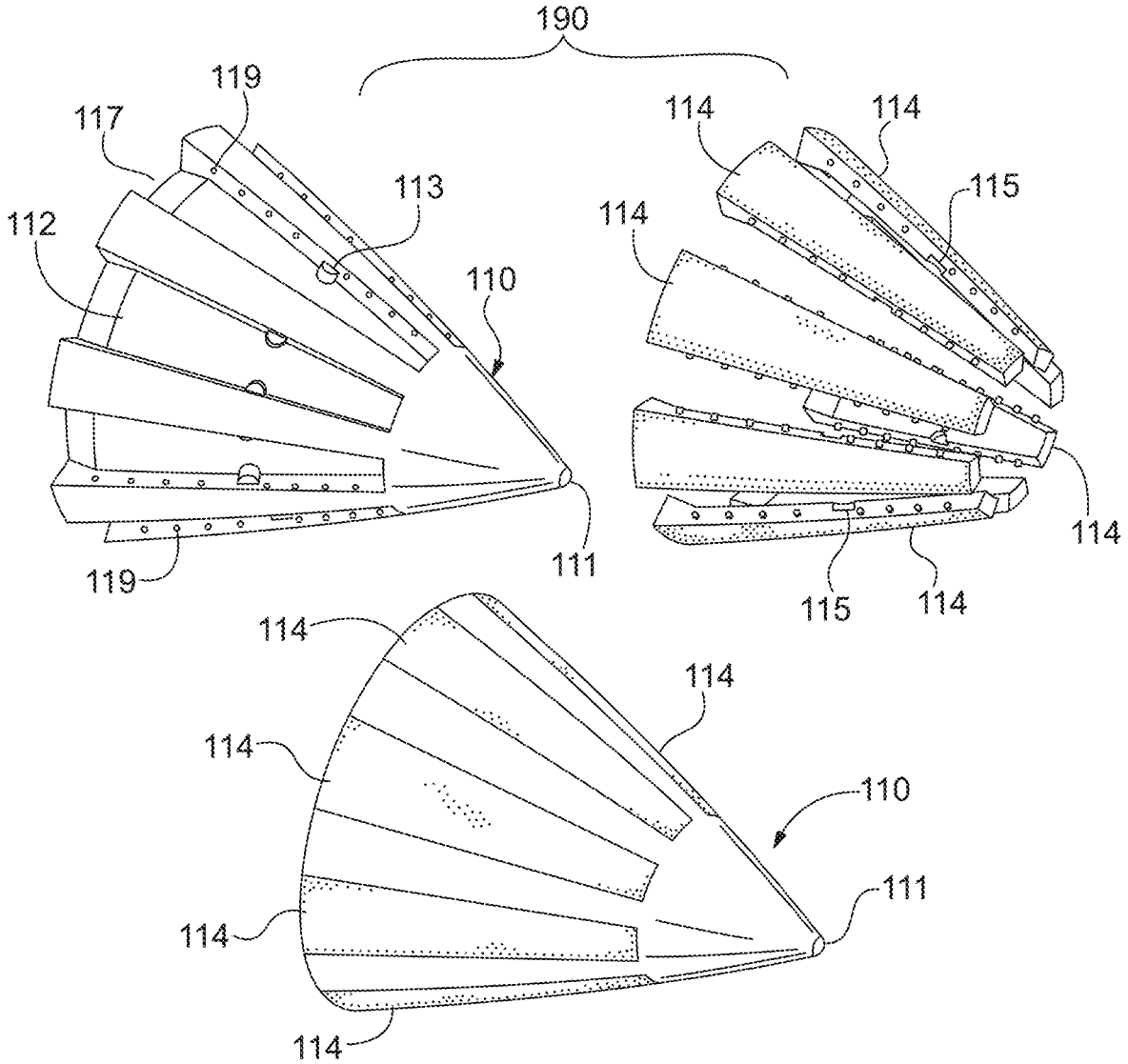
FIG. 5 schematically illustrates integration of mechanical features of the design of FIGS. 1A, 1B into full-wave electromagnetic modeling incorporating the conductivity of an aluminum metal nosecone and injection moldable dielectric material.
Figure 7A:
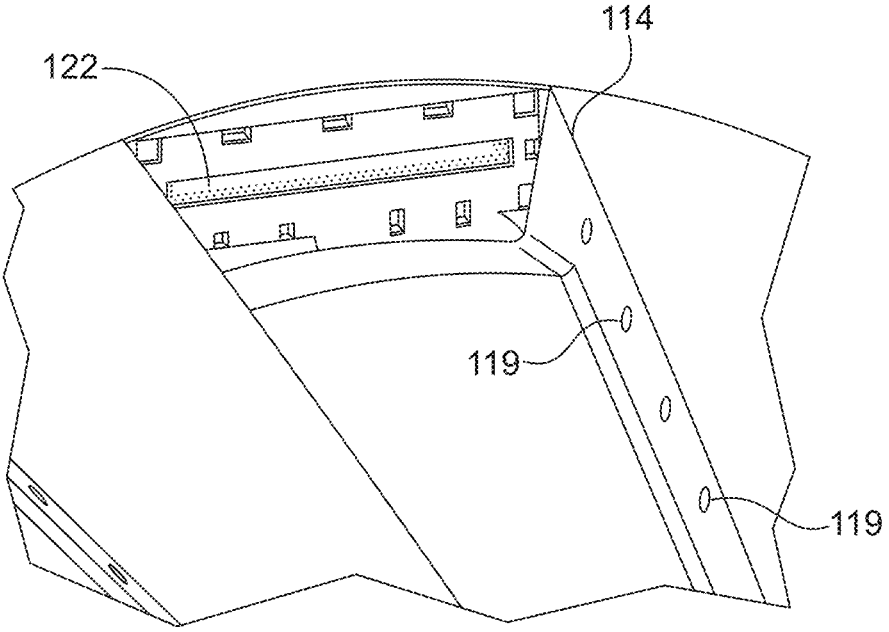
FIG. 7A schematically illustrates an enlarged partial view of a dielectric-loaded waveguide of FIG. 1B detailing the waveguide slot feed of FIG. 4C disposed thereat.
Figure 7B:
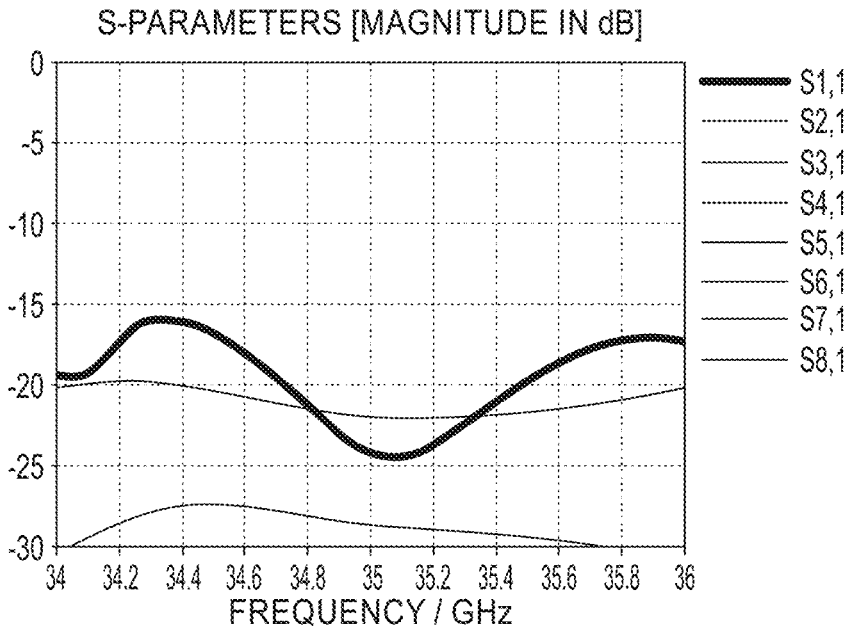
FIG. 7B illustrates return loss for the structure of FIG. 7A.

A PolyStrata® implementation of the waveguide slot transition can be seen in FIG. 4A-4C, where the stippled areas correspond to the dielectric and the non-stippled correspond to metal. One important aspect of the transition is that the slot 122 feeding the dielectric-loaded waveguide 114 is loaded with dielectric. This helps to miniaturize the back-slot cavity and pull the energy forward. Furthermore, this microstrip style fed slot 122 quickly transitions to low-loss PolyStrata® coax to interface with the beamforming network. Mechanical featuring associated with the machining of the aluminum nosecone 110 and injection molding of the PREPERM® dielectric material waveguides 114 have been incorporated into the electromagnetic model of FIG. 5. The shallow holes 119 on the waveguide side walls represent areas where the molded material grip into the aluminum metal housing of the nosecone recesses 112. With respect to FIGS. 4A-4C, release holes and the dielectric locking features have been added to the model where the waveguide slot transition is a key aspect of the design. With the fabrication details incorporated into the model, FIG. 7A, the full antenna simulation is shown, FIG. 7B. As it can be seen, the return loss is better than −15 dB across the 34 to 36 GHz frequency range.

Figure 6:
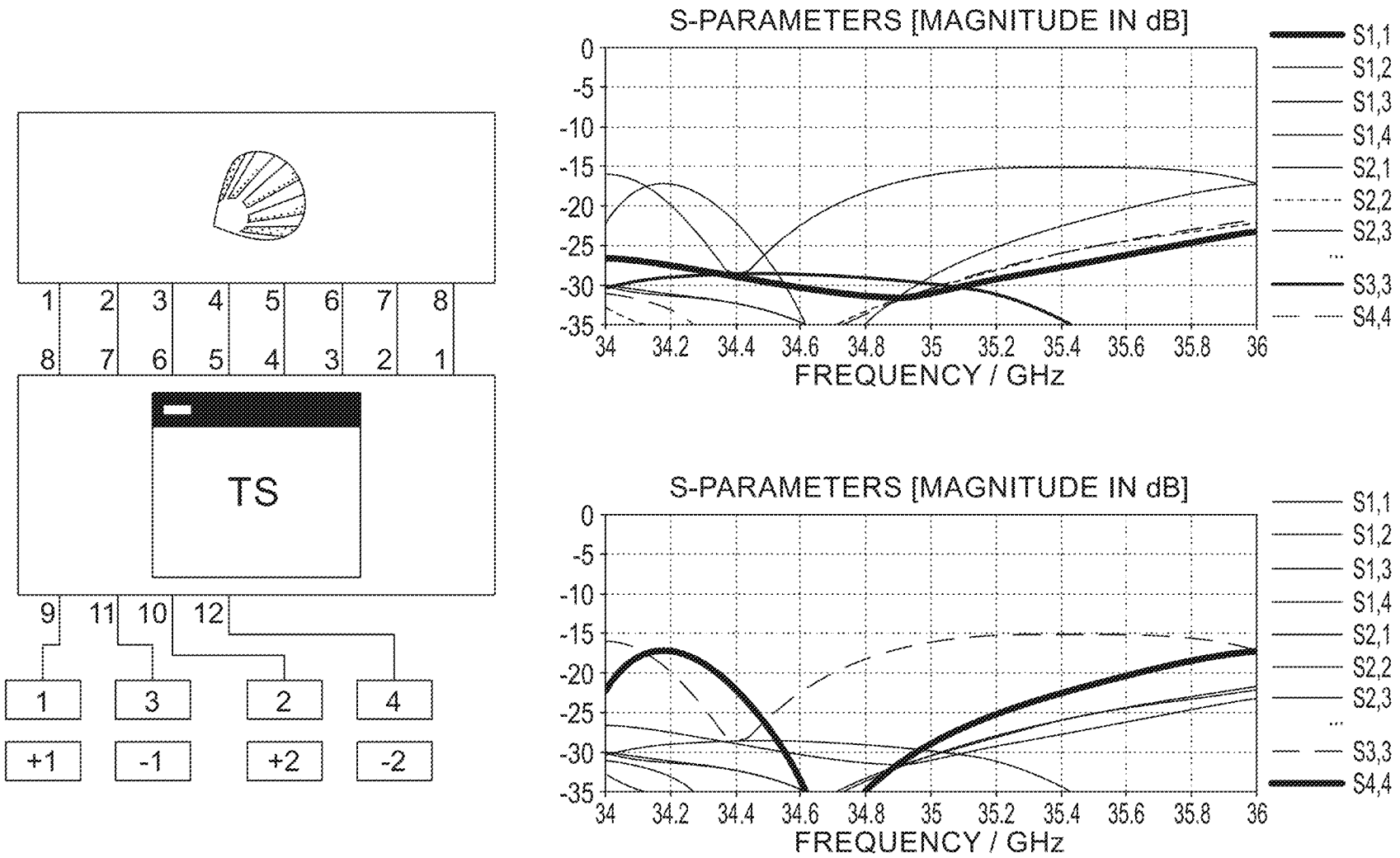
FIG. 6 illustrates S-parameter results capturing full-wave coupling between the eight leaky dielectric-loaded waveguides of FIG. 5 and the beamformer FIG. 1B.

Fullwave simulation indicates the loss of a single dielectric-loaded waveguide 114 is between 0.6 and 0.7 dB. S-parameter results capturing full coupling between the eight dielectric-loaded waveguides 114 of FIG. 5 and beamforming network 120 can be seen in FIG. 6. The return loss terms for the 4 mode ports is low and corresponds well with beamformer predictions. The S31 and S42 terms, FIG. 6, can be thought of as the true antenna system return loss terms, since any reflection witnessed at the antenna interface reflects into the beamformer's mode port with opposite circular polarization. Said another way, any energy transmitted into Mode +1 port will reflect into Mode −1 port and similarly for Mode 2.

Two designs were created and prototyped: one aimed at a low temperature and a second design aimed at high temperature capability.

First (Electromagnetic (EM)) Prototype Nosecone Fabrication

Figure 9A:
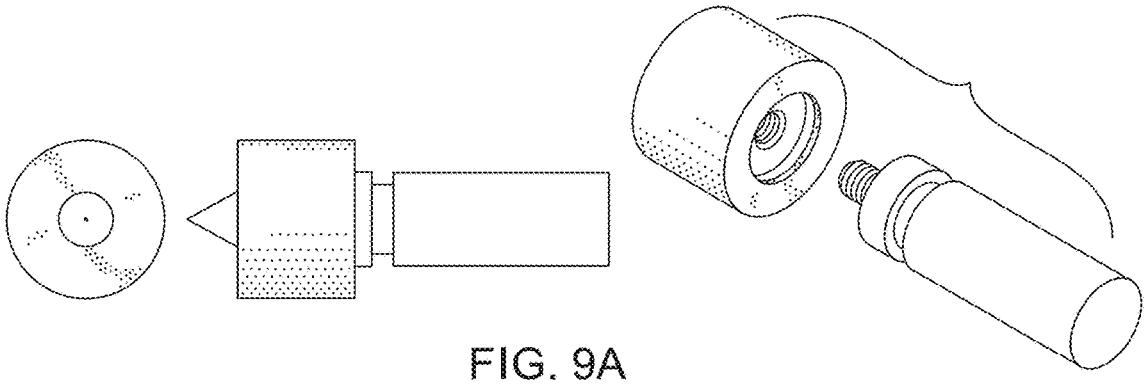
FIGS. 9A, 9B schematically illustrate a manufacturing processes used to create an exemplary nosecone of the present invention with over-molding and final machining of an electromagnetic prototype in accordance with the present invention, with FIG. 9A showing an RF plastic over-mold represented by the cylinder, and FIG. 9B showing final machining to create an ogive profile.
Figure 9B:
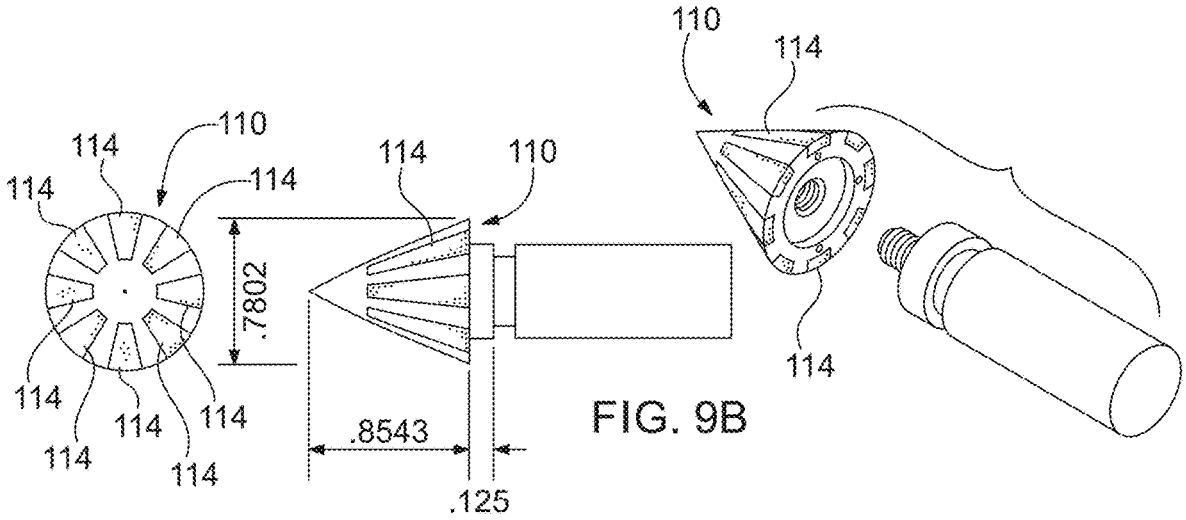
Figure 10:
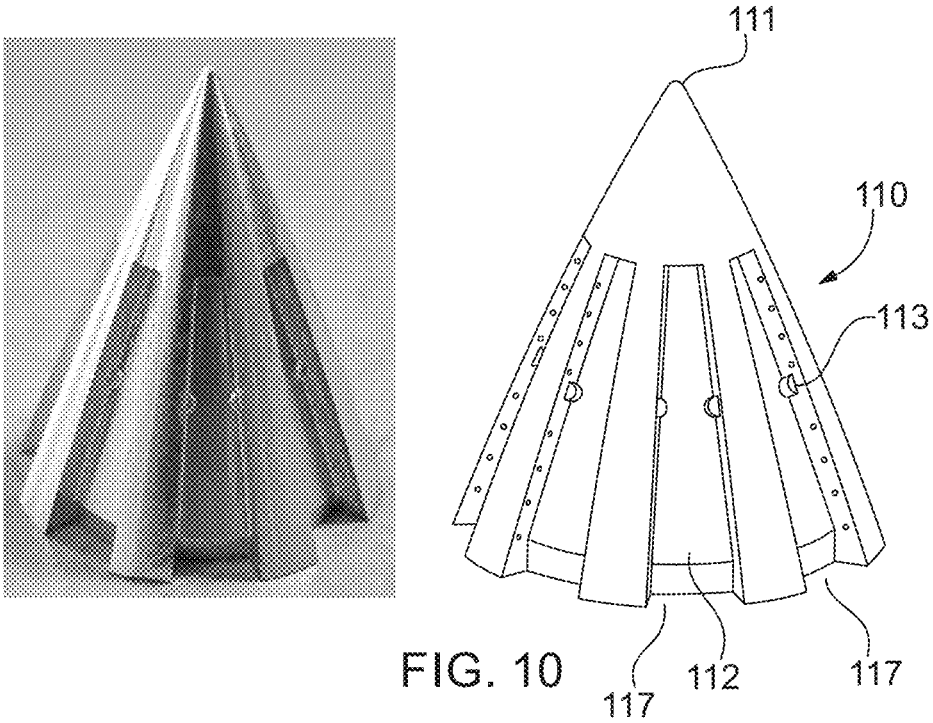
FIG. 10 illustrates a photograph and schematic image of a nosecone fabricated in accordance with the present invention.
Figure 11:
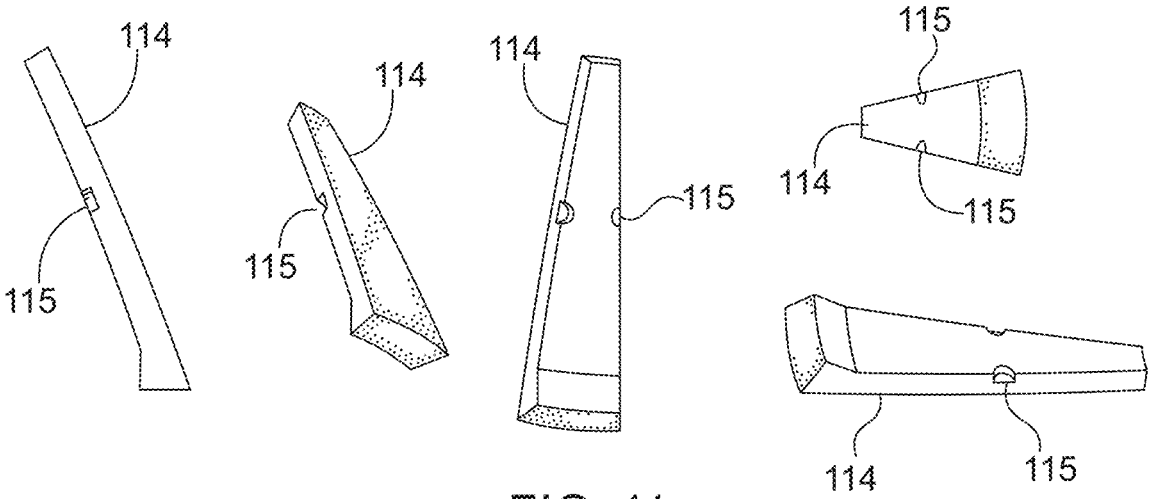
FIG. 11 schematically illustrates various views of the leaky dielectric-loaded waveguides of FIGS. 1A, 1B.
Figure 12A:
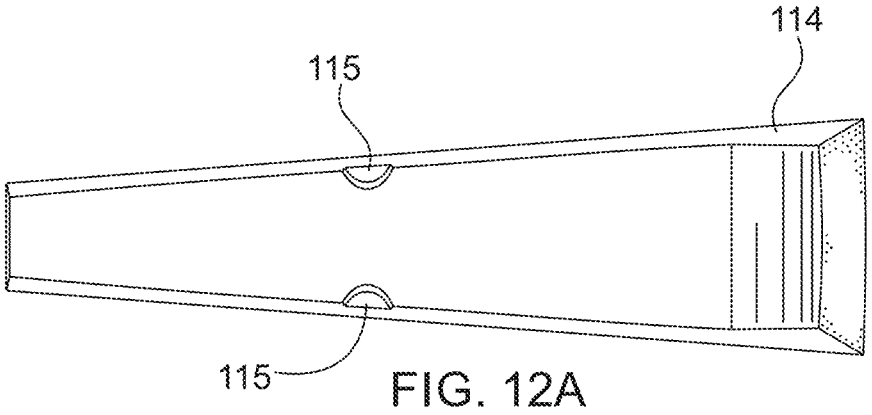
FIGS. 12A, 12B illustrate bottom and top views, respectively, as-fabricated of the leaky dielectric-loaded waveguides of FIG. 11, with RF impedance matching nubs shown in FIG. 12A.
Figure 12B:
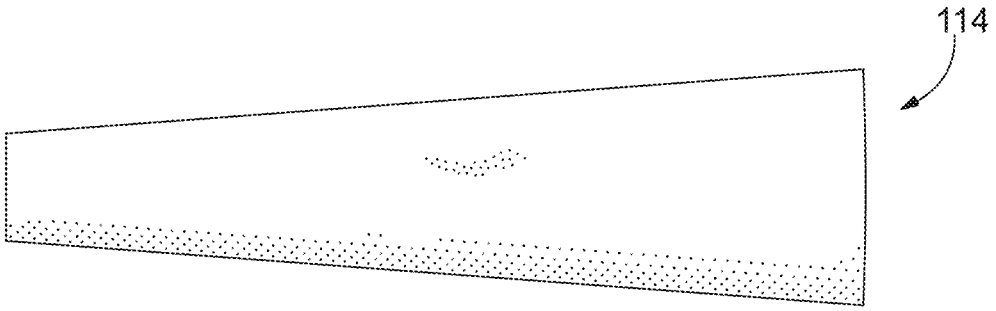
Figure 13:
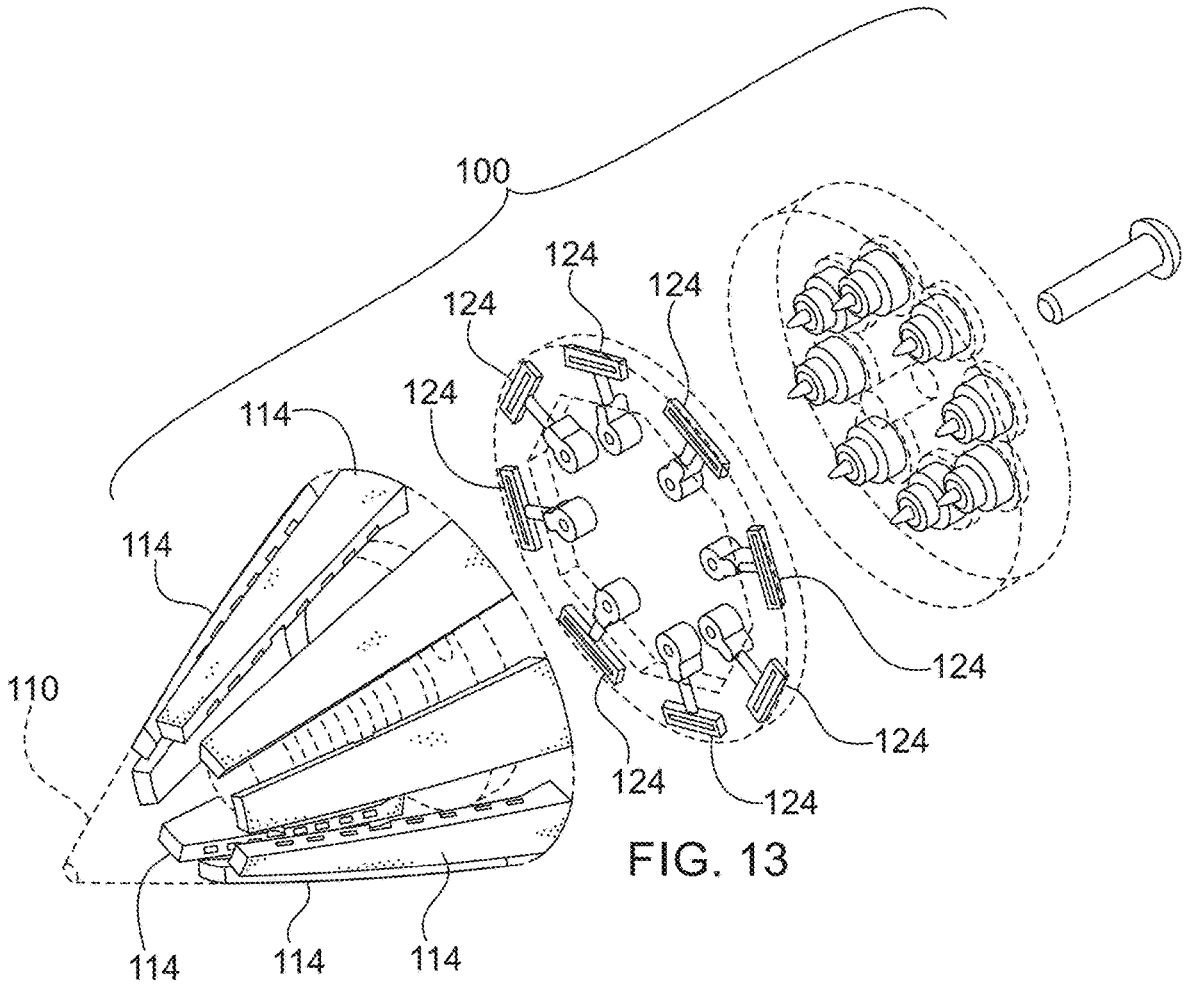
FIG. 13 schematically illustrates a more detailed exploded view of the antenna/feed-only prototype of FIG. 1B.

The low temperature version termed "EM prototype" uses an engineered thermoplastic, PREPERM® L900HF from Premix Group, which is a moldable thermoplastic that has controlled dielectric properties. This design was intended to more quickly enable having a test vehicle for the beam forming network and antenna. The mechanical design utilized machined aluminum prototype metal cone tips which were subsequently insert molded with the PERPERM® L900HF thermoplastic. The nosecone 110 was machined to achieve the desired ogive cone shape and precise surface flatness to ensure good mating to the beam-former feed network 120, FIGS. 9A-10. A temporary mandrel was utilized in the process to hold the nosecone 110 during machining. The PolyStrata® beamformer 120 was then aligned and attached to the cone tip assembly and tested before and after being secured to the projectile body. Blind mate connectors were utilized for concept validation testing as the RF interface to the PolyStrata® beamformer 120. Alternatively, deployed systems could eliminate these connectors by interfacing directly to the active RF processing hardware. FIG. 10 illustrates a photograph of a test nosecone 110 as fabricated along with an image of a simulated view of the part using a CAD model from the fabrication drawings. Alternatively, a future design could possess a notched/sloped wall design.

Second Prototype Nosecone Fabrication

In addition to fabricating the EM prototype nosecones 110, an alternate manufacturing path to fabricate a "live-fire-like" prototype nosecone 110 that could survive the aerothermal structural/heating environment. The goal of the second metal/dielectric nosecone prototype is a drop-in replacement for the EM prototype nosecone 110, demonstrating progress towards an antenna nosecone which can survive increased projectile speeds and higher temperature.

Two ideas were researched for live-fire prototypes for elevated temperature use. The first idea was to use machined alumina pieces for the dielectric material of the waveguides 114 which would be metalized using evaporation or deposition techniques, enabling the ceramic to subsequently braze to a metal nosecone 110. The nosecone 110 could be made using PM (Powder Metallurgy) technology to provide the necessary shape or be machined to the desired shape. The second idea was to use a ceramic slurry which is a thick film dielectric ceramic paste and to fill the nosecone recesses 112 with the slurry to provide the waveguides 114. The ceramic slurry material is liquidus at room temperature and becomes solid after firing at 850 C. An advantage to using paste is that it can maintain the internal recess 112 shape, and once fired it will fuse directly to metal surface without the need to metalize or braze it. The ceramic dielectric constant (7.5-9.5) is consistent with what is needed to implement the dielectric-loaded waveguides 114. To get an ogive external form, the ceramic metal hybrid may require final post grinding. The ceramic firing temperature of 850 C is below the melt point of metals such as Kovar; however, the temperature should be selected to avoid any PM phase transformations or elevated temperature issues.

The two leading candidate metals identified for nosecone fabrication were Kovar® ASTM F15 nickel-iron alloy & Copper Tungsten (15/85). Table 3 captures some relevant properties along with ceramic candidate materials alumina and MACOR® machinable glass ceramic (Corning, Inc.).

TABLE 3

Second (Live Fire) Prototype Material Candidates

| Materials | CTE [10−6/K] | Density | Elec. Cond. [%] | Thermal Conductivity [W/m-K] |
|---|---|---|---|---|
| Alumina | 8.1 | 3.9 | | 31.7 |
| MACOR | 9.3 | 2.52 | | 1.46 |
| Tungsten | 4.5 | 19.3 | | 173 |
| Kovar | 5 | 8.36 | | 17 |
| Copper | 16.5 | 8.96 | 100 | 385 |
| W—Cu alloys | 6-16 | | | |
| Cu 90% W | <7.5 | 16.5 | <30 | 170 |
| Cu 80% W | 8.8 | 15 | 38-45 | 180 |
| Cu 75% W | 9.5 | 14.3 | 41-48 | 190 |

| Composition wt. % | Density $g/cm^3$≥ | Hardness HB $Kgf/mm^2$≥ | Resistivity μΩ · cm≤ | IACS %≥ | Bending strength Mpa≥ |
|---|---|---|---|---|---|
| W50/Cu50 | 11.85 | 115 | 3.2 | 54 | — |
| W55/Cu45 | 12.30 | 125 | 3.5 | 49 | — |
| W60/Cu40 | 12.75 | 140 | 3.7 | 47 | — |
| W65/Cu35 | 13.30 | 155 | 3.9 | 44 | — |
| W70/Cu30 | 13.80 | 175 | 4.1 | 42 | 790 |
| W75/Cu25 | 14.50 | 195 | 4.5 | 38 | 885 |
| W80/Cu20 | 15.15 | 220 | 5.0 | 34 | 980 |
| W85/Cu15 | 15.90 | 240 | 5.7 | 30 | 1080 |
| W90/Cu10 | 16.75 | 260 | 6.5 | 27 | 1160 |

Possible fabrication methods for the metal nosecone 110 were identified as 1) machining 2) direct metal laser sintering printing, and 3) metal injection molding. Ultimately, for the second prototype we decided to machine both the copper-tungsten nosecone 110 and the alumina waveguides 114. The waveguides 114 were machined from alumina and then brazed into the copper tungsten nosecone 110 and ground to provide the waveguides 114 in the nosecone 110.

In yet a further exemplary configuration, an antenna 210 in accordance with the present invention may include a cone-shaped dielectric-loaded waveguide tip 240 as the tip of the projectile which, with the waveguide tip 240 operating in conjunction with the leaky dielectric-loaded waveguides 114 to provide another antenna element, FIGS. 14A, 14B. The dielectric-loaded waveguide tip 240 may transmit a high-power signal radiated therefrom, and a reflected signal may be received by the leaky dielectric-loaded waveguides 114, or vice-versa.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An antenna integrated into a compact conical nosecone, comprising a plurality of leaky dielectric-filled waveguides circumferentially spaced about an outer surface of the nosecone and embedded therein, with the plurality of leaky dielectric-filled waveguides having an outer surface disposed flush with an outer surface of the conical nosecone, the outer surfaces of the waveguide and nosecone configured to provide a continuous surface.

2. The antenna of claim 1, wherein the nosecone has a tip at an apex of the cone and has an opposing aft end and a longitudinal axis extending therebetween, and wherein the plurality of leaky dielectric-filled waveguides taper towards the tip along the direction of the longitudinal axis.

3. The antenna of claim 2, wherein the plurality of leaky dielectric-filled waveguides taper in the circumferential direction from a widest circumferential dimension at the aft end and narrowest circumferential dimension proximate the tip.

4. The antenna of claim 1, comprising a slot transition electronically coupled to a respective one of the plurality of leaky dielectric-filled waveguides to provide electromagnetic energy to a respective waveguide.

5. The antenna of claim 4, wherein the slot transition is filled with a dielectric.

6. The antenna of claim 1, wherein the plurality of leaky dielectric-filled waveguides are configured to leak energy therefrom at an orientation which collimates the energy leaked therefrom along the longitudinal axis extending away from a tip.

7. The antenna of claim 1, comprising a transmit antenna disposed at a nosecone tip.

8. The antenna of claim 7, comprising a circular dielectric waveguide disposed in the nosecone and electromagnetically coupled to the transmit antenna.

* * * * *